US005406866A

United States Patent [19]

Badiali

[11] Patent Number: 5,406,866

[45] Date of Patent: Apr. 18, 1995

[54] SPEED-SELECTABLE SCREWDRIVER

[76] Inventor: John A. Badiali, 10 Opal Ave., Middleboro, Mass. 02346

[21] Appl. No.: 103,855

[22] Filed: Aug. 9, 1993

Related U.S. Application Data

[63] Continuation-in-part of Ser. No. 831,927, Feb. 6, 1992, abandoned.

[51] Int. Cl.[6] ..... B25B 17/00

[52] U.S. Cl. ..... 81/57.3; 81/59.1; 81/57.31

[58] Field of Search ..... 81/52, 57.3, 57.31, 81/59.1

[56] References Cited

U.S. PATENT DOCUMENTS 3,908,487 9/1975 Plaw ..... 81/59.1

4,485,699 12/1984 Fuller ..... 81/59.1

*Primary Examiner*—James G. Smith

*Attorney, Agent, or Firm*—Kirschstein, Ottinger, Israel & Schiffmiller

[57] ABSTRACT

The drive speed of a drive shaft of a screwdriver is selectable by a user by holding a gear transmission housing. Two sets of pinch rollers are employed to rotate the drive shaft at one speed. When the housing is held, one set of pinch rollers is disengaged from the drive shaft, while the other set is engaged through a step-up gear transmission to rotate the drive speed at a greater speed.

12 Claims, 2 Drawing Sheets

SPEED-SELECTABLE SCREWDRIVER

CROSS-REFERENCE TO RELATED APPLICATION

This application is a continuation-in-part of U.S. Ser. No. 07/831,927, filed Feb. 6, 1992, now abandoned.

BACKGROUND OF THE INVENTION

1. Field of the Invention

This invention generally relates to rotary drive tools such as screwdrivers and wrenches and, more particularly, to reversible, ratchetless tools whose turning speed is selectable by a user.

2. Description of Related Art

Reversible, ratchet tools utilizing conventional pawl, ratchet and spring assemblies are generally satisfactory, except that such tools tend to be noisy during operation due to the generation of a characteristic "clicking" sound. Also, such tools are subject to backlash which requires them to be turned through a small, but non-negligible, distance before the tool drivingly re-engages a fastener. Moreover, such tools are sensitive to dust, grime and other contaminants, thereby subjecting them to increased wear. Reversible, ratchet tools of this type are exemplified by U.S. Pat. Nos. 1,904,621; 2,003,155; 2,897,932; 3,621,739; 3,679,031; 3,908,487; 4,362,073; and 4,485,699.

It is also known to increase the turning speed of such tools by pushing axially along a drive shaft against a fastener to be turned. Experience has shown, however, that such tools are awkward to operate, particularly when the fastener is about to be threaded into a threaded hole. At such time, it is desirable to use the higher turning speed. However, since this requires the user to push hard against the fastener, often the fastener is pushed over, thereby requiring the user to re-position the screw in the hole—a laborious and aggravating process.

SUMMARY OF THE INVENTION

Objects of the Invention

It is a general object of this invention to provide an improved rotary drive tool for driving and removing fasteners with an increased speed, control and efficiency.

It is another object of this invention to provide a long-wearing drive tool not overly sensitive to dust, grime and other contaminants.

Another object of this invention is to provide a durable drive tool which is quiet in operation and not subject to backlash.

A further object of this invention is to provide a drive tool of simple construction and economical manufacture.

Features of the Invention

In keeping with these objects, and others which will become apparent hereinafter, one feature of this invention resides, briefly stated, in a drive tool for manually turning a rotary load. The tool may either be a screwdriver, or a wrench, or analogous rotary drive tool.

The tool includes a drive shaft which extends between opposite end regions along an axis, and a holder on the drive shaft for holding a bit for engaging the rotary load. Preferably, the holder can interchangeably hold standard ¼" hexagonal screwdriver bits for various screw head types. A magnet may be incorporated into the holder to retain the bit in place.

The tool further includes a handle manually turnable about the axis. In the preferred embodiment, the handle is mounted at one of the end regions of the drive shaft, and has a bore in which an insert is fixedly mounted for joint turning movement with the handle. The insert has an interior, non-circular wall that has a plurality of cam surfaces at a first radial distance from the axis, and a corresponding plurality of slip surfaces at a second radial distance greater than said first radial distance from the axis.

A first clutch and a second clutch are provided for turning the drive shaft, during turning of the handle, at a first angular drive speed (normal speed) about the axis. The first clutch includes a first set of rollers circumferentially arranged about the axis in a force-transmitting relationship with the handle and the drive shaft.

The tool also includes an overdrive sleeve which extends along the axis, surrounds the drive shaft, and has an axially-splined portion. The second clutch includes a second set of rollers circumferentially arranged about the axis between the interior wall of the insert and the sleeve. An actuatable step-up transmission is operative, together with the second set of rollers and the sleeve, for turning the drive shaft, during turning of the handle, at a second angular drive speed (overdrive operation) greater than said first speed about the axis to obtain a mechanical advantage over the rotary load.

The aforementioned first set of rollers is arranged between the interior wall of the insert and the drive shaft. The aforementioned second set of rollers is arranged between the interior wall of the insert and the sleeve. Each set of rollers cammingly engages the cam surfaces during turning of the handle in a drive direction to transmit turning force from the handle to the shaft and the sleeve during turning of the drive shaft at said first speed.

The step-up transmission includes a gear train mounted in a housing. The gear train meshingly engages the splined portion of the sleeve and a splined portion of the shaft.

In normal speed operation, as the handle is turned in the drive direction, the first and second sets of rollers cammingly engage the cam surfaces and turn the shaft and the sleeve, respectively. Hence, the drive shaft, the sleeve and the housing are turned jointly in the same direction and through the same angular distance as the handle is turned, thereby resulting in a 1:1 speed ratio.

In overdrive operation, the housing is prevented from being turned with the handle. Preferably, the housing is grasped and held stationary relative to the handle by a user. By holding the housing stationary, the gears in the gear train rotate relative to one another and turn the sleeve in the same direction and through a multiple of the angular distance as the handle is turned. In the preferred embodiment, this multiple is four times, thereby resulting in a 4:1 speed ratio.

As the sleeve is turned in the drive direction, the second set of rollers remain cammingly engaged with the cam surfaces, but the first set of rollers are disengaged from the cam surfaces, thereby allowing the second set of rollers to alone effect the turning of the sleeve and the drive shaft. The overdrive operation is selected by the user by the expedient of holding the housing of the gear train. During normal speed operation, the housing and the gear train contained therein rotate as a unit about the axis during turning of the handle. However, once the housing is held by the user and effectively prevented from participating in the turning movement of the handle, the gears of the train rotate relative to one another and cause the drive shaft to rotate at the aforementioned 4:1 speed ratio.

Hence, driving a screw or analogous fastener is no longer dependent upon the user pushing axially against the fastener as described above, but, instead, is accomplished in a more controlled and efficient manner by holding the transmission housing. In either normal speed operation or overdrive operation, turning of the handle in a direction opposite to that of the drive direction causes the respective first and second sets of rollers to be moved toward the slip surfaces of the insert. Alternate movement of the handle in the drive direction and in the opposite direction produces a motion similar to rachet drive action, but silent and stepless in its operation.

The drive direction may be selected to be either clockwise or counter-clockwise by the user, as desired, depending on whether the fastener is to be driven into or out of a work surface.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
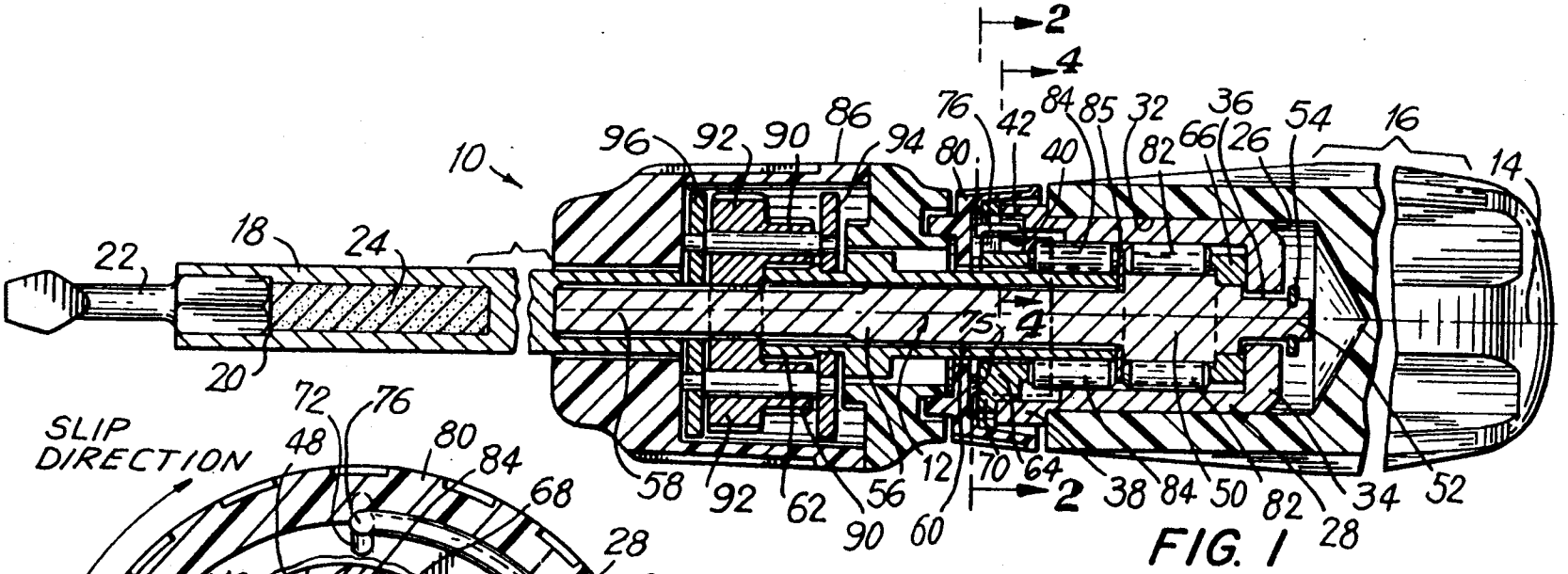
FIG. 1 is an axial sectional view of a drive tool according to this invention.

Referring now to the drawings, reference numeral 10 generally identifies a drive tool, e.g., a screwdriver, for manually turning a rotary load, e.g., a screw. Although illustrated and described in connection with a screwdriver, the tool can be a wrench for driving and removing fasteners such as bolts or, for that matter, can be any rotary, manually-operated tool.

The tool 10 comprises a drive shaft 12 extending along an axis 14 between opposite end regions. The handle 16 is mounted at one of the end regions and is manually turnable in either circumferential direction about the axis 14. The handle 16 has an exterior roughened surface to enable a user to have a better grip thereon. A bit holder 18 is keyed onto, and extends axially away from, the other end region of the shaft. The bit holder 18 has an axial passage 20 for interchangeably receiving the metal shank of a selected one of a set of tool bits. Bit 22 represents a standard ¼" hexagonal slot-head bit for reception in the passage 20 which has a complementary hexagonal cross-section. A magnet 24 is fixedly mounted within the holder 18 to magnetically attract and retain the bit 22 in the passage 20.

The handle 16 has a central bore 26 into which a cup-shaped handle insert 28 is press-fitted. Axial ribs 30 at the exterior of the insert 28 press firmly against the interior wall bounding the bore 26 to insure joint turning movement with the handle. The insert 28 is hollow, and has an interior, non-circular side wall 32, a base wall 34 having an aperture 36, an enlarged annular rim 38 on which a detent projection or bump 40 extends both axially and radially (see FIGS. 2 and 3). A pair of angularly-offset recesses 42, 44 flank the bump 40 and are used, as described in detail below, to select the drive direction of the tool. The non-circular side wall 32 has a generally square-shaped outline with rounded corners.

The side wall 32 has a plurality of cam surfaces 46 located at a first radial distance form the axis 14, and a corresponding plurality of slip surfaces 48 located at a second radial distance greater than the first radial distance away from the axis 14. The slip surfaces 48 are rounded arcs that are located at the corners of the square, whereas the cam surfaces 46 are linear and are located at the sides of the square.

As best shown in FIG. 1, the drive shaft 12 has an enlarged, cylindrical body portion 50, a rear cylindrical portion 52 of reduced diameter, and a front portion 56, also of reduced diameter. The rear portion 52 extends axially rearwardly away from the body portion 50 through the aperture 36 of the base wall 34 and is retained thereon by a snap-on C-clip 54. The front portion 56 extends axially forwardly from the body portion 50 and terminates in an axially-splined end 58.

An overdrive sleeve 60 extends axially along part of the length of the front portion 56, and co-axially surrounds the same. A sun gear 62 is fixedly mounted on a front end region of the overdrive sleeve. The sun gear may be a separate part or may be formed integral with the sleeve. The sun gear 62 is part of a gear transmission whose operation is described in greater detail below.

A cup-shaped member or roller cage 64 has a cylindrical side wall 66 through which a plurality of axially-extending channels 68 are formed. The channels 68 are equi-angularly arranged about the axis. The cage 64 has a central hole through which the drive shaft extends. The sleeve 60 also extends part-way through the cage 64. The cage 64 has an enlarged annular head 70 in which an elongated opening or slot 72 and a circular opening 74 are formed. A semi-circular spring 75 having two spring ends 76, 78 are respectively received in the slot 72 and opening 74. The spring 75 extends over, and is supported by, half the periphery of the head 70. The spring end 76 is longer than the spring end 78, and extends through and beyond its slot 72 into adjacent relationship with the bump 40. An accessible rotary knob 80 having a roughened outer surface is mounted axially adjacent, and is operatively connected to, the cage 64 for joint movement. Preferably, the knob 80 and the cage 64 are glued together around the periphery of the head 70 within the knob 80. Turning of the knob 80 and the cage 64 causes the longer spring end 76 to engage and be pushed by the bump 40 on the insert 28. The longer spring end 76 moves along the slot 72 through a limited angular distance to position the longer spring end 76 in either recess 42 or 44 on either side of the bump 40. This action is described below in greater detail in connection with the selection of the drive direction of the tool.

A first clutch includes a first set of cylindrical pinch rollers 82, preferably four in number, one for each cam surface 46, which are circumferentially arranged about the axis. Rollers 82 are mounted respectively in the rear regions of the channels 68 of the cage 64. The channels 68 are oversized relative to the rollers 82 to permit a limited freedom of movement in the circumferential direction about the axis.

A second clutch includes a second set of cylindrical pinch rollers 84, also four in number, one for each cam surface 46, which are circumferentially arranged about the axis. Rollers 84 are mounted respectively in the front regions of the channels 68 of the cage 64. Again, the channels 68 are oversized relative to the rollers 84.

The rollers 82, 84 in each channel 68 are axially aligned adjacent each other. All of the rollers 82, 84 are situated within the hollow interior of the insert 28, and are surrounded by the interior side wall 32. Rollers 82 are in rolling contact with the body portion 50 of the drive shaft 12. Rollers 84 are in rolling contact with the outer surface of the overdrive sleeve 60. A spacer ring 85 having a set of four radially-extending fingers extends into and through each channel 68 to separate the first set of rollers 82 from the second set of rollers 84 in each channel. Advantageously, each roller 82, 84 is constituted of a hard, rigid metal material.

An outer casing or housing 86 is mounted on, and surrounds, the front portion 56 of the drive shaft 12 axially adjacent the rotary direction selector knob 80. A speed step-up gear transmission 88 is mounted within the housing 86. A set of three planetary gears 90 equiangularly surround, and mesh with, the aforementioned sun gear 62. The planetary gears 90 have a smaller diameter than the sun gear. Integral with, or co-axially mounted on the same gear shaft as the planetary gears, is a set of three auxiliary gears 92, each jointly rotatable with a respective planetary gear. The auxiliary gears 92 have the same diameter as the sun gear 62, and equiangularly surround and mesh with the splined front end 58 of the drive shaft 12. A pair of non-circular, triangular mounting plates 94, 96 support three gear shafts on which the respective pairs of gears 90, 92 rotate. The plates 94, 96 are fixedly held within the housing 86.

Figure 4:
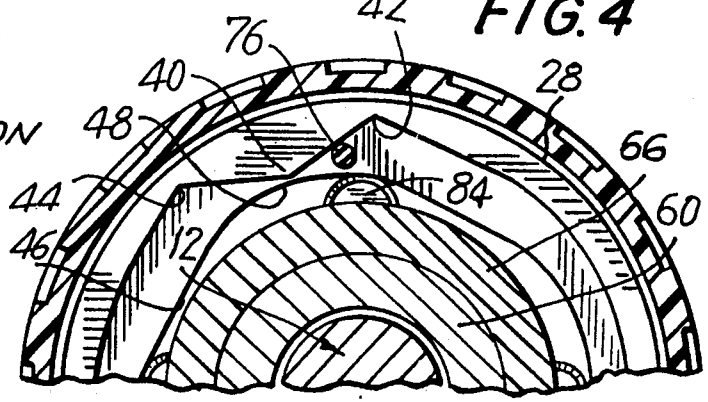
FIG. 4 is a cross-sectional view taken on line 4—4 of FIG. 1.

In operation, after selecting and mounting the appropriate tool bit 22 into the bit holder 18, a user must select the drive direction, which can be either clockwise or counter-clockwise, depending on whether the tool 10 is to be used to drive or remove a threaded fastener. The drive direction is selected by turning the knob 80 either clockwise or counter-clockwise. Turning of the knob 80 causes the cage 64 and the spring 75 to jointly turn therewith relative to the insert 28. The tip of the longer spring end 76 is engaged and pushed by the stationary bump 40 to position the longer end 76 in either recess 42 or 44 (see FIG. 4). The longer end 76 travels along the slot 72 during this movement.

With the drive direction so selected, the user turns the handle 16 counter-clockwise along the drive direction about the axis. The handle insert 28 jointly turns with the handle. The rollers 82 are individually driven counter-clockwise by the turning insert 28 into the cam surfaces 46, and are forced radially into force-transmitting engagement against the body portion 50 of the drive shaft. At the same time, the rollers 84 are individually driven counter-clockwise by the turning insert 28 into the cam surfaces 46, and are forced radially into force-transmitting engagement against the overdrive sleeve 60. The drive shaft 12 and the overdrive sleeve 60 rotate in the same direction and speed as the handle. During this 1:1 speed ratio operation, the gear transmission 88 is inoperative and merely rotates as a unit together with the handle. The gears 92 are meshed with the front splined end 58 of the drive shaft and, due to mutual friction, none of the other gears in the transmission rotate relative to one another.

Figure 2:
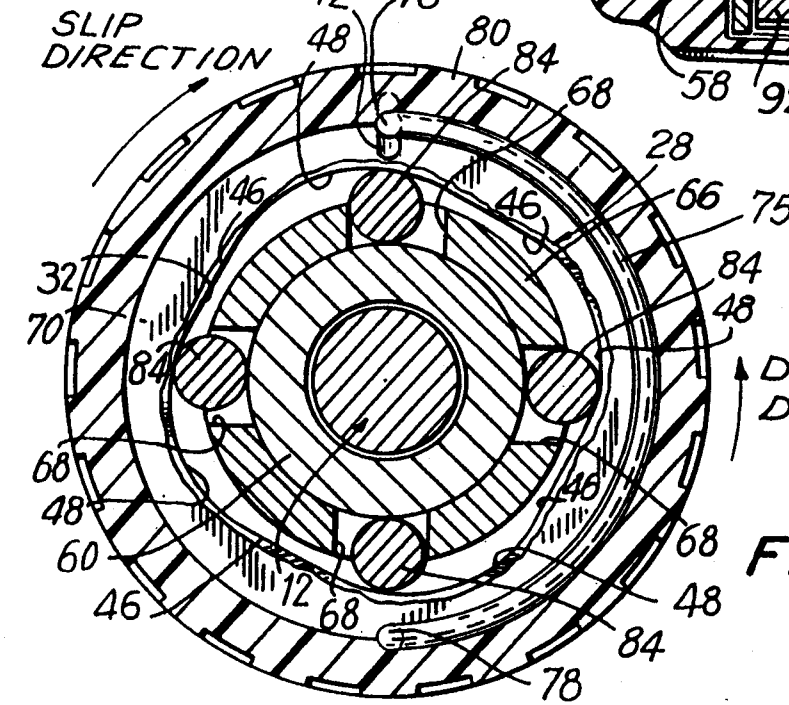
FIG. 2 is a cross-sectional view taken on line 2—2 of FIG. 1.
Figure 3:
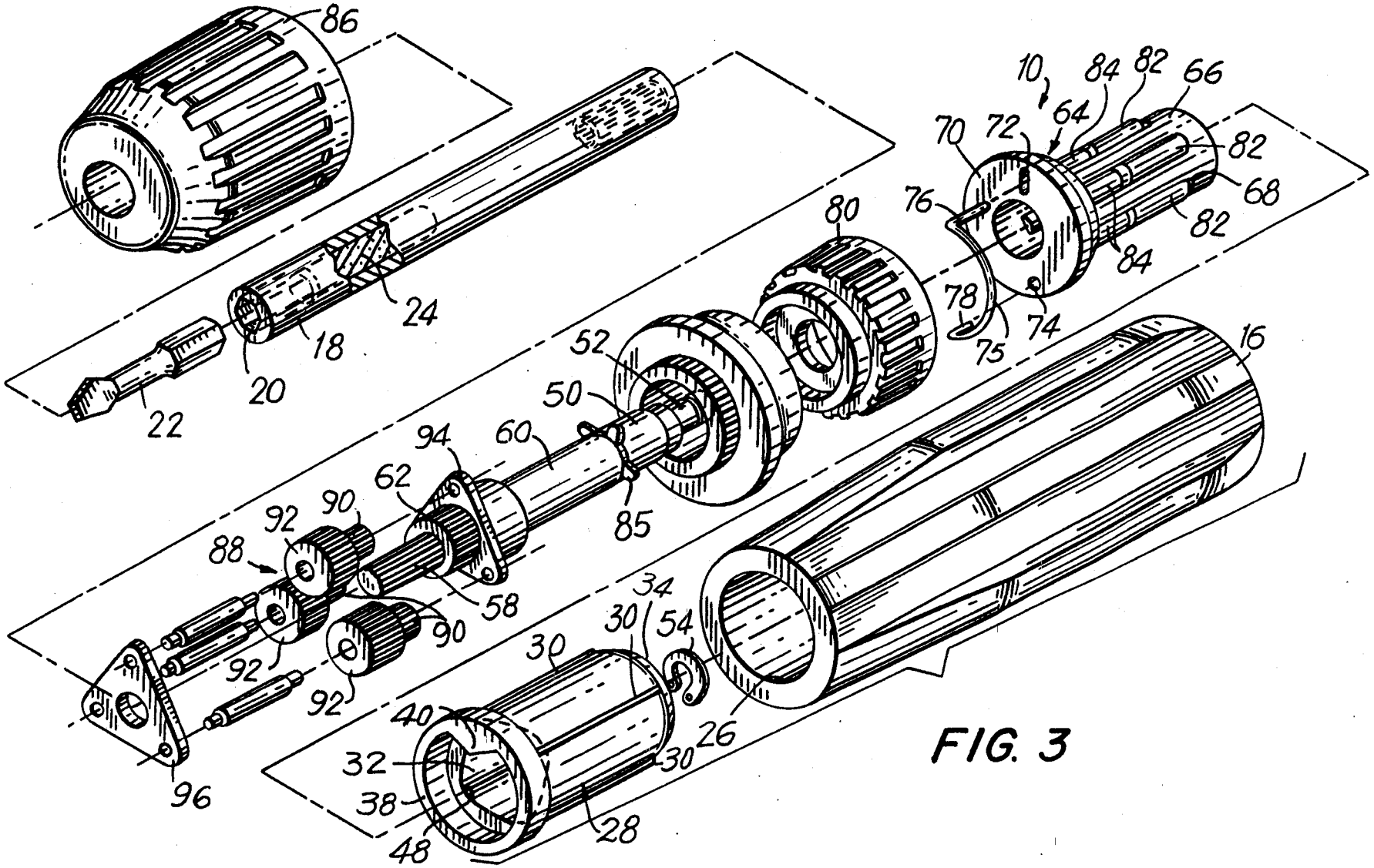
FIG. 3 is an exploded perspective view of the tool of FIG. 1.

When the handle is turned clockwise in the opposite direction, which has been designated in FIG. 2 as the "slip" direction, the rollers 82 and 84 are moved to overlie slip surfaces 48 where the additional radial clearance causes rollers 82 and 84 to be disconnected from the body portion 50 of the drive shaft and the overdrive sleeve, respectively. The rollers 82 and 84 now slip relative to the drive shaft and the sleeve, and cannot transmit torque from the handle.

The alternate turning of the handle, first in the drive direction and then in the slip direction, produces a motion similar to a ratchet drive action, but silent and stepless in its operation. No minimum backward motion or backlash is required to re-engage the drive, as would be necessary in conventional pawl, ratchet and spring assemblies.

To increase the turning speed of the drive shaft 12, the user grasps and holds the gear train housing 86 stationary with respect to the turning of the handle. The housing 86, the mounting plates 94, 96 and the gear shafts are all prevented from turning with the handle.

In this case, when the handle 16 is turned in the drive direction against the load, the rollers 84 are, as described below, individually driven counter-clockwise into the cam surfaces 46 and forced radially into force-transmitting engagement against the outer surface of the overdrive sleeve 60. The sleeve 60 rotates in the same direction and speed as the handle 16. As the sleeve 60 rotates in the drive direction, so does the sun gear 62. The sun gear 62 rotates the planetary gears 90 and, in turn, the auxiliary gears 92, thereby turning the gears 90, 92 in a direction opposite to that of the sun gear. Since the auxiliary gears 92 mesh with the front splined end 58 of the drive shaft, the auxiliary gears 92 turn the drive shaft 12 in the same direction as the handle, but this time, with an increased angular speed as determined by the gear ratio of the transmission. This gear ratio is set in advance by the respective diameters of the gears. In the preferred embodiment, the gear diameters are so selected that the speed ratio is 4:1 during the just-described overdrive operation.

During this overdrive operation, the increased angular speed of the drive shaft 12 (in the drive direction) relative to the slower angular speed of the insert 28 (also in the drive direction) causes body portion 50 to move ahead of the insert 28, in the same drive direction. This advancement of the position of the drive shaft 12 with respect to the handle causes the rollers 82 to move the cage 66 in the drive direction until the rollers 82 are positioned in overlying relationship with the slip surfaces 48, thereby disengaging the rollers 82 from the body portion 50 of the drive shaft 12. The oversized channels 68 permit the rollers 84 to remain engaged with the cam surfaces 46, while the rollers 82 are overlying the slip surfaces 48.

In the same manner as described for the 1:1 speed operation, rotating the handle in the slip direction during overdrive operation causes the rollers 84 to move in overlying relationship with the slip surfaces 48. The alternate turning of the handle in the drive and slip directions produces a ratchet-like drive action as previously described.

It will be understood that each of the elements described above, or two or more together, also may find a useful application in other types of constructions differing from the types described above.

While the invention has been illustrated and described as embodied in a speed-selectable screwdriver, it is not intended to be limited to the details shown, since various modifications and structural changes may be made without departing in any way from the spirit of the present invention.

Without further analysis, the forgoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A drive tool for manually turning a rotary load, comprising:

(a) a drive shaft extending along an axis;

(b) means on the drive shaft for engaging the rotary load;

(c) a handle manually turnable about the axis;

(d) an actuatable step-up transmission mounted on the tool;

(e) a first clutch mounted on the tool in force-transmitting relationship with the handle and the drive shaft;

(f) a second clutch mounted on the tool in force-transmitting relationship with the handle and the drive shaft via the step-up transmission;

(g) both clutches being together operative for turning the drive shaft, during turning of the handle, at a first angular drive speed about the axis; and (h) said first clutch being disengaged from the drive shaft upon actuation of the transmission, to enable said second clutch to turn the drive shaft, during turning of the handle, at a second angular drive speed greater than said first speed about the axis to obtain a mechanical advantage over the rotary load.

2. The tool according to claim 1, wherein the first and second clutches respectively include first and second sets of rollers circumferentially arranged about the axis.

3. The tool according to claim 2, wherein the handle has a bore, and a handle insert fixedly mounted in the bore for joint turning movement with the handle, said insert having an interior, non-circular wall that has a plurality of cam surfaces at a first radial distance from the axis, and a plurality of slip surfaces at a second radial distance greater than said first radial distance from the axis; and wherein the first and second sets of rollers are cammingly engaged by the cam surfaces during turning of the drive shaft at said first angular drive speed.

4. The tool according to claim 3, wherein the transmission includes an overdrive sleeve surrounding the drive shaft and extending along the axis, and wherein the second set of rollers is circumferentially arranged about the axis in force-transmitting relationship with the handle and the sleeve; and wherein the transmission further includes a gear train mounted in a housing and having at least one gear in meshing engagement with the sleeve.

5. The tool according to claim 4, wherein the first and second sets of rollers are arranged axially adjacent each other, and wherein the cam and slip surfaces of the interior wall of the insert extend over the second set of rollers.

6. The tool according to claim 5, wherein the housing surrounds the drive shaft and is mounted for joint turning movement with the handle during turning of the drive shaft at said first angular speed, and wherein the second set of rollers is cammingly engaged by the cam surfaces and radially pressed against the sleeve when the housing is prevented from turning with the handle during actuation of the transmission.

7. The tool according to claim 2, wherein each roller of the first and second sets is a cylindrical pinch roller extending along the axis.

8. The tool according to claim 4, wherein the clutches are operative for turning the drive shaft in a given drive direction about the axis to drive the load; and further comprising direction actuator means for reversing the drive direction about the axis, said direction actuator means including a cup-shaped cage having a cylindrical side wall extending axially between the insert, on one side, and the sleeve and the drive shaft, on the other side; and wherein the side wall has a plurality of axially-extending channels in which the rollers are received.

9. The tool according to claim 8, wherein the cup-shaped cage has a radially-extending flange, and wherein the direction actuator means includes a detent projection extending axially and radially of the insert, a pair of angularly-offset recesses at opposite sides of the projection, a spring mounted on the flange and having a movable spring end, and an exterior knob operatively connected to the flange for moving the spring end relative to the projection to a selected one of the recesses.

10. The tool according to claim 4, wherein the gear train has a step-up gear ratio which increases the second speed to be four times higher than the first speed.

11. The tool according to claim 4, wherein the housing includes an exterior roughened surface to facilitate manual grasping thereof during turning of the drive shaft at said second drive speed.

12. A screwdriver, comprising:

(a) a drive shaft extending along an axis between opposite end regions;

(b) a bit holder at one of the end regions for holding a screwdriver bit;

(c) a handle at the other of the end regions and manually turnable about the axis, said handle having a bore;

(d) a handle insert fixedly mounted in the bore for joint turning movement with the handle, said insert having an interior, non-circular wall that has a plurality of cam surfaces at a first radial distance from the axis, and a plurality of slip surfaces at a second radial distance greater than said first radial distance from the axis;

(e) a step-up transmission including a gear train mounted in a housing mounted on the drive shaft;

(f) a first clutch including a first set of cylindrical rollers circumferentially arranged about the axis between the interior wall of the insert and the shaft;

(g) an overdrive sleeve extending along the axis, surrounding the shaft, and having an axially splined portion;

(h) a second clutch including a second set of cylindrical rollers circumferentially arranged about the axis between the interior wall of the insert and the sleeve;

(i) said first and second sets of rollers cammingly engaging the cam surfaces during turning of the handle in a drive direction to transmit turning force from the handle to the shaft and the sleeve at a first angular drive speed about the axis;

(j) said gear train meshingly engaging the splined portion of the sleeve and the shaft;

(k) said first set of rollers being moved to overlie the slip surfaces and be disengaged from the drive shaft during turning of the handle in the drive direction by preventing the turning of the housing with the handle, to enable the second set of rollers to cammingly engage the cam surfaces and transmit turning force from the handle via the gear train to the shaft at a second angular drive speed greater than the first speed about the axis; and (l) means for selecting the drive direction.

* * * * *